US005717179A

United States Patent [19]

Meyer

[11] Patent Number: 5,717,179

[45] Date of Patent: Feb. 10, 1998

[54] CLOSET LIGHT SWITCH

[76] Inventor: Daniel J. Meyer, 5 Wyndtop La., Creve Coeur, Mo. 63141

[21] Appl. No.: 678,083

[22] Filed: Jul. 10, 1996

[51] Int. Cl.[6] ..... H01H 13/18

[52] U.S. Cl. ..... 200/61.81; 200/61.82

[58] Field of Search ..... 200/61.62, 51.04, 200/61.7, 61.71, 61.73, 61.74, 61.76, 61.78, 61.81, 51.05, 61.82, 51.06, 51.11, 51.14, 51.17; 307/112, 114; 315/362; 362/94, 95, 147, 151, 148, 150, 251, 362, 368, 190, 184, 364, 365, 366, 433, 448, 457, 434, 435, 437, 394, 404, 100; 439/119, 217, 220, 226, 231, 232, 236, 242, 243, 375, 550, 551, 660, 661, 662, 663, 664, 666, 667, 702, 851, 140, 230, 893

[56] References Cited

U.S. PATENT DOCUMENTS

| | | | |
|---|---|---|---|
| 1,625,456 | 4/1927 | Cramblet | 200/61.62 |
| 2,053,373 | 9/1936 | Money | 200/54 |
| 2,122,293 | 6/1938 | Pleasant et al. | 240/4 |
| 2,238,630 | 4/1941 | De Reamer | 200/54 |
| 2,331,564 | 10/1943 | Okoneski | 200/54 |
| 2,418,905 | 4/1947 | Sage | 200/54 |
| 2,436,909 | 11/1948 | Babajoff | 200/54 |
| 2,636,091 | 4/1953 | Carter | 200/54 |
| 2,717,933 | 9/1955 | Carden | 200/61.82 |
| 2,788,407 | 4/1957 | Brown | 200/61.82 |
| 2,835,760 | 5/1958 | Ringwald | 200/61.82 |
| 3,234,342 | 2/1966 | Murray | 200/51 |
| 3,479,498 | 11/1969 | Lesseigne | 240/2 |
| 3,496,451 | 2/1970 | Duncan | 323/26 |
| 4,872,095 | 10/1989 | Dubak et al. | 362/100 |
| 5,113,044 | 5/1992 | Tomberlin | 200/51.04 |
| 5,121,287 | 6/1992 | Lee | 361/331 |

*Primary Examiner*—Michael L. Gellner
*Assistant Examiner*—Michael A. Friedhofer
*Attorney, Agent, or Firm*—Edward H. Renner

[57] ABSTRACT

A combination switch and socket is provided that can be easily installed without rewiring an existing fixture to give the user a closet light that automatically turns on when the closet door is opened and turns off when the door is closed. The socket can be screwed into an existing light fixture and the switch can be mounted near the door by merely attaching a bracket adjacent the door. Then, wires connecting the socket and switch can be placed where desired and even attached along the ceiling out of the way in a conventional conduit.

18 Claims, 2 Drawing Sheets

CLOSET LIGHT SWITCH

FIELD OF THE INVENTION

This invention relates to the field of light switches. More particularly, this invention enables a standard light socket to be converted to a self-contained light switch unit that is responsive to activation of a closure, for example, opening of a door.

BACKGROUND OF THE INVENTION

This invention involves a closure controlled light switch unit that can be used to easily modify an existing pull string light fixture into one that is operated upon the closing and opening of a door or other closure. The device of the invention can be built into new construction or provided as a kit which can be retrofitted to existing structures.

Conventional closets have either no light within the closet or a pull string light fixture, which is activated by pulling a string or chain to turn the light switch on and off. This requires action by the individual once the closet door has been opened. An individual must step into a dark closet to turn the light switch on and remember to turn the light switch off when leaving.

There are some walk-in closets which may contain lighting fixtures activated by a wall switch. These lights may be turned on and off without walking into the closet but require an individual to remember to operate the switch so as not to leave the light on once the door is closed.

It may be possible to take an existing pull string light fixture and rewire it to provide a light switch that is activated by the closing and opening of a door. However, this rewiring is not easy, is expensive and usually cannot be done by the average consumer.

The present invention overcomes these and other disadvantages in a manner not revealed in the known prior art.

Applicant is aware of the following U.S. Patents, the disclosures of which are incorporated by reference herein:

U.S. Pat. No. 1,625,456
U.S. Pat. No. 2,122,293
U.S. Pat. No. 2,238,630
U.S. Pat. No. 2,331,564
U.S. Pat. No. 2,418,905
U.S. Pat. No. 2,486,909
U.S. Pat. No. 2,636,091
U.S. Pat. No. 2,717,933
U.S. Pat. No. 2,788,407
U.S. Pat. No. 2,835,760
U.S. Pat. No. 4,872,095

SUMMARY OF THE INVENTION

This invention provides a light switch unit, particularly a closet light switch, that is activated by the closing and opening of a closet door and can be adapted to an existing pull string light fixture. The invention provides a mechanical extension socket with male and female light receptacles with its terminals connected to a separate switch.

It is an object of this invention to provide a closet light switch that can be installed by an unskilled individual in approximately five minutes.

It is a further object of this invention to provide a closet light switch that can be easily adapted to a standard pull string light fixture.

It is another object of this invention to provide a closet light switch that is energy efficient because the light is turned off automatically when the closet door is closed.

This invention uses existing power, therefore, requiring no additional wiring.

The light switch of this invention helps prevent fire hazards because, when the closet door is closed, the light is off, therefore, items near the light bulb will not catch on fire from the heat of the light while the door is closed and a light left on.

It is an object of this invention to provide a more convenient light fixture that does not require an individual to search in the dark for a pull string to turn on the light.

It is an object of this invention to provide a switch unit kit that can be retrofitted to existing structures.

It is a further object of this invention to provide a kit comprised of a switch and a socket adaptor that can be used in any conventional closet light socket.

It is also an object of this invention to provide a kit for hinged closet doors and sliding closet doors.

It is an object of this invention to provide a kit including a switch, a socket adaptor and wires extending therebetween to provide an all inclusive kit for the consumer.

The closet light switch of the invention is inexpensive to manufacture, simple to use and efficient in operation. Further understanding of the invention may be obtained by reference to the drawings and the description of embodiments included herein.

DESCRIPTION OF THE PREFERRED EMBODIMENTS

Figure 1:
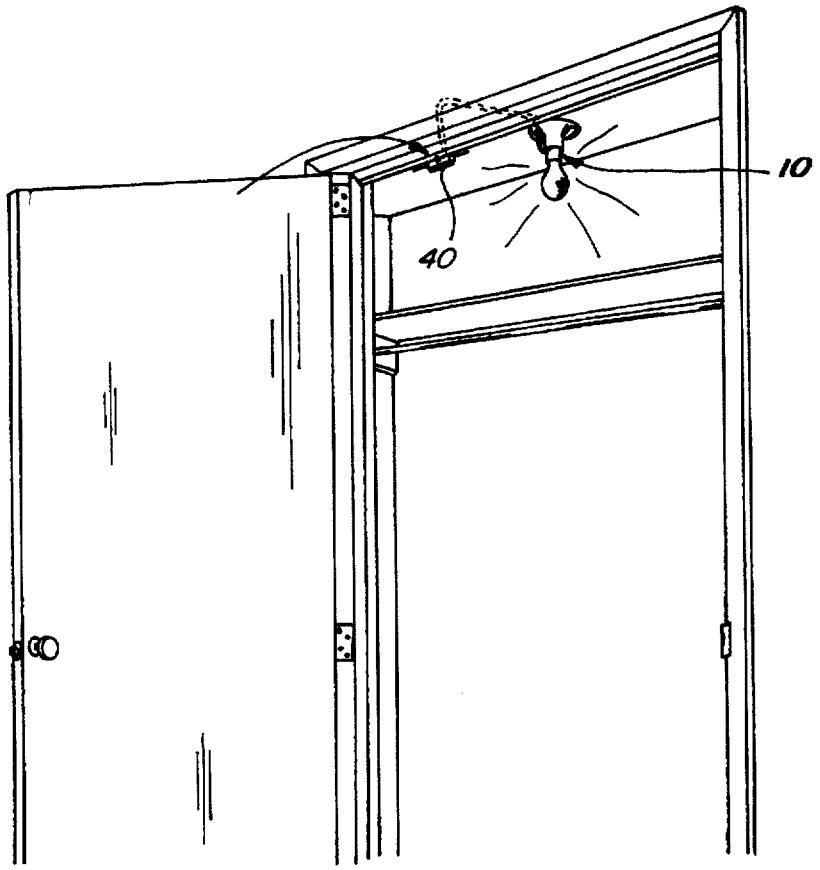
FIG. 1 is a perspective of a switch and socket combination installed in a standard closet.
Figure 4:
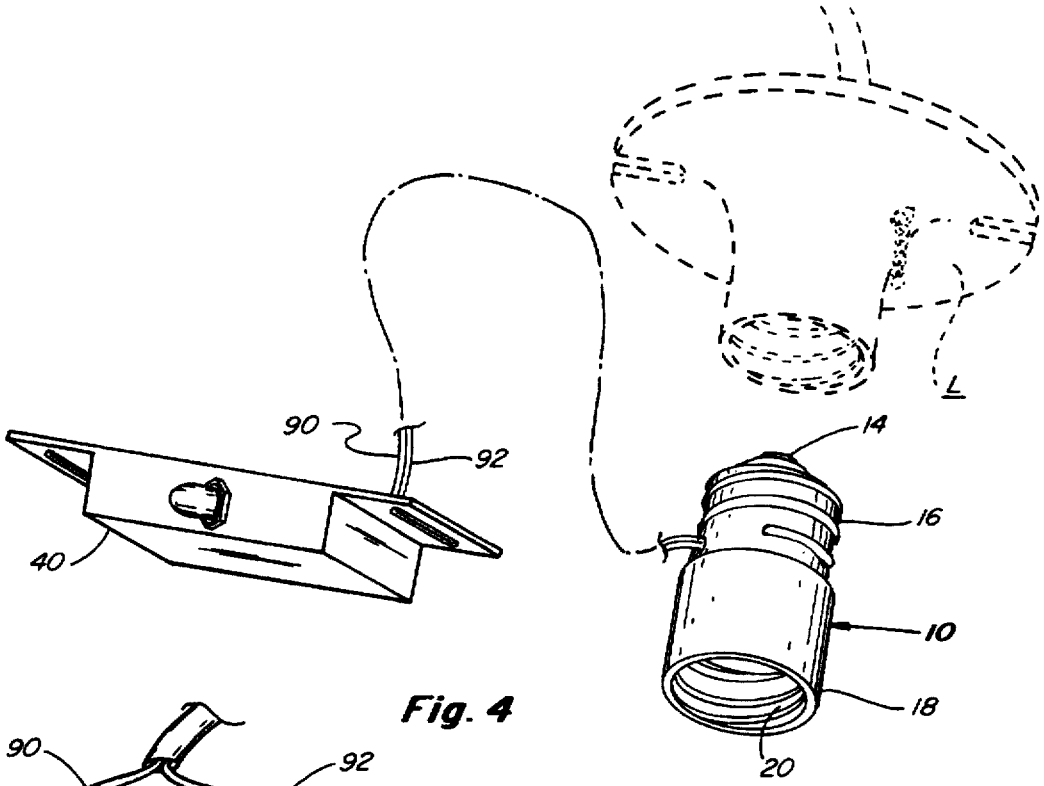
FIG. 4 is an exploded perspective view of a switch and socket combination with an existing light fixture shown for environment.

Referring now by reference numerals to the drawings and first to FIGS. 1 and 4, it will be understood that the combination socket and switch adaptor includes a socket 10 and a switch 40 operatively connected by a conductor such as the wires 90, 92 shown. The socket can be screwed into any conventional light fixture L and the switch can be mounted adjacent either a hinged or sliding door.

Figure 5:
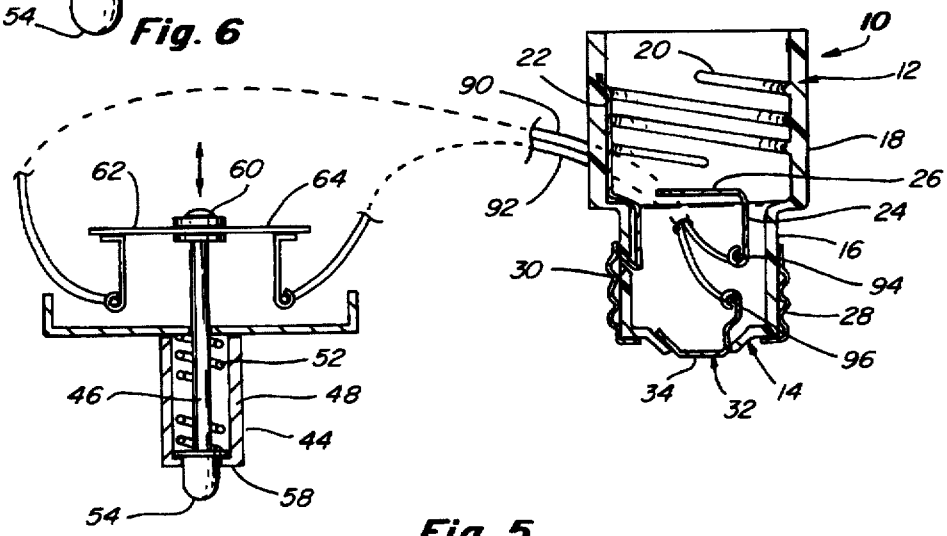
FIG. 5 is a cross sectional view of a switch and socket combination.

As can be seen in FIGS. 4 and 5, the socket adapter 10 includes a housing 12 having a lower 14, an intermediate 16 and an upper portion 18. The housing 12 can be formed from any suitable insulating material such as synthetic plastic, ceramic, hard rubber or the like. The housing 12 is generally cylindrical with the upper portion 18 being wider than the intermediate portion 16 which is wider than the lower portion 14. The upper portion 18 of the housing 12 is internally threaded to allow a light bulb to be screwed into the upper portion 18 of the housing as seen in FIG. 1. These threads 20 mate with the threads found at the lower end of a conventional light bulb.

As best seen in FIG. 5, there is a first conducting strip 22, or buss, extending from inside the upper housing portion 18 into the intermediate housing portion 16 and then outside the intermediate housing portion 16. This conducting strip 22, or buss, may be in the form of a pliable metal strip. There is a second conducting strip 24, or buss, extending from inside the upper housing portion 18 and terminating inside the intermediate housing portion 16. This second conducting strip 24 has a first portion 26 lying generally flat near the bottom of the upper housing portion in such a manner as to contact the bottom or conducting end of a standard light bulb.

As seen in FIG. 5, there is a cover 28 encasing a portion of the intermediate housing 16 and extending to a portion of the lower housing 14. This cover is made from conducting material such as a thin pliable sheet metal, such as copper or copper plated steel. The first conducting strip 22 extends from inside the intermediate housing portion 16 through an aperture 30 in the housing 16 and ends such that it contacts this conducting cover 28. Thus, the cover 28 conducts power between a standard light fixture L and the first conducting strip 22 which touches the threaded, metal end of a standard bulb.

There is a third conducting strip 32, or buss, positioned generally within the lower housing portion 14. A portion 34 of the third conducting strip 32 lies generally flat at the bottom end of the lower housing portion 14 forming an end 34 to the housing that contacts the conductors (not shown) within an existing light socket.

As demonstrated in FIG. 5, a conductor 90, such as the wire shown, is attached at one end 94 to the second conducting strip 24. There is a second conductor 92, such as the wire shown, attached at one end 96 to the third conducting strip 32. Thus, the socket 10 can be screwed into an existing light fixture L and the third conducting strip portion 34 contacts the light fixture L drawing power and transmitting it to wire conductor 92. Wire conductor 90 transmits power from the switch to the second conducting strip 24 which transfers it from end 26 to the bottom end of a standard bulb (not shown).

Figure 2:
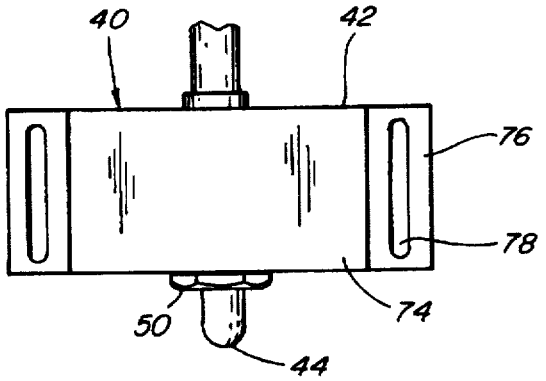
FIG. 2 is a bottom view of a switch.
Figure 6:
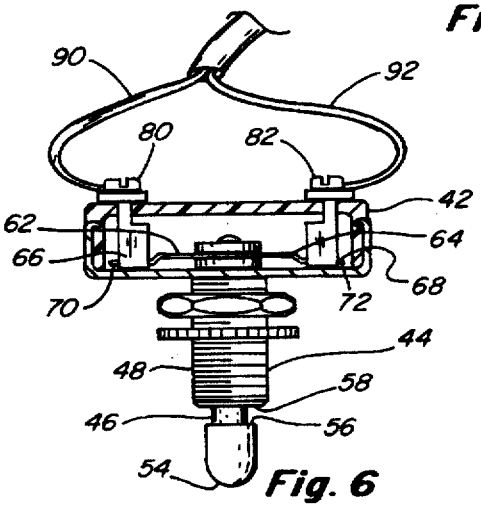
FIG. 6 is a perspective view of a switch.

For hinged doors, the switch 40 may be a plunger type switch such as that shown in FIGS. 2, 5 and 6 and it may include a casing 42, for example formed from plastic. It is preferable to have an insulated casing 42 as opposed to a metal casing when dealing with electrical wiring, but suitable insulated metal casings could also be used. The casing 42 has an opening 50 along one side with an actuating member 44 extending therefrom. The actuating member 44 consists of a pin 46 extending through a hollow member 48 and kept in the outward position by a spring 52. The outermost end of the pin 46 has a generally rounded or flat head 54 for contact against a door. The underside of the head forms a lip 56 that is stopped against the edge 58 of the hollow member 48 when the pin 46 is pushed inwards.

Figure 7:
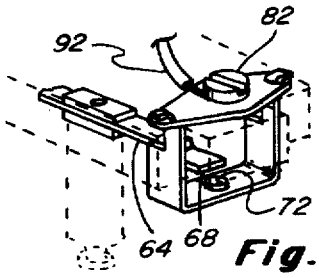
FIG. 7 is a perspective view of a sensor with the pin shown for environment.

As shown in FIGS. 5, 6 and 7, The end 60 of the pin 46 opposite the head 54 is connected to two contact arms 62, 64 which carry a pair of contacts 66, 68. When the pin is in the outermost position, each contact 66, 68 contacts a mating contact portion 70, 72 and the circuit is completed. When pressure is applied to the head of the pin, such as by a door that has been closed, the pin 46 is pushed inwards and the contacts 66, 68 are urged out of contact with the mating portions 70, 72 and the circuit is broken, thereby turning off the light.

The contacts 66, 68 are connected to the conducting wires 90, 92 such as by the screws 80, 82 shown. The wires 90, 92 are wrapped around the screws 80, 82 and held in place by screwing the screws into the contacts 66, 68. These wires are normally encased in conduits made from insulated material for safety reasons. These wires 90, 92 and conduits extend between the switch 40 and adaptor socket 10.

In general, the moveable contact 66, 68 provided on the contact arms 62, 64 complete an electrical circuit when the door is open. The moveable contact 66, 68 are spaced from their mating fixed contact 70, 72 deactivating the electrical circuit when the door is closed.

The switch may be mounted at or near a door frame by a bracket 74, such as shown in FIGS. 1 and 2. The ears 76 of the bracket have an aperture 78 for receiving a fastener such as a screw (not shown). Thus, a switch 40 can be mounted by merely screwing it near a door with the actuating member 44 placed at a distance from the door for activation by the opening and closing of the door.

To install the combination socket 10 and switch adaptor 40 in a closet, the user merely has to screw the socket 10 into an existing light socket L and mount the switch 40 adjacent the closet door. The switch 40 should be mounted such that the pin 46 is compressed when the door is closed. The switch 40 can be mounted by screwing the bracket 74 where desired. The wires 90, 92 can be placed anywhere including attaching them along the ceiling out of the way, for example, in a conventional conduit.

Figure 3:
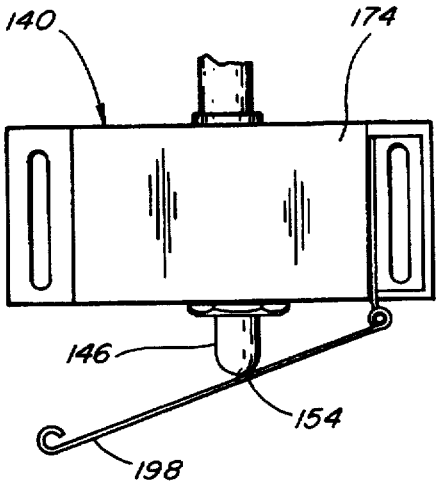
FIG. 3 is a bottom view of an alternative embodiment switch.

In an alternative embodiment of the invention, the switch 140 is adapted for use with sliding doors, as shown in FIG. 3. A lever 198 is fixed at one end to the fastening bracket 174 and extends across the pin 146 coming into contact with the head 154 of the actuating pin 146. The outermost end of the lever 198 is positioned adjacent the sliding door so that when a door is slid closed, pressure is applied to the lever 198, thus urging the actuating pin 146 inwards.

All of the invention has been described by making detailed reference to preferred embodiments. Such detail should be understood by those skilled in the art as instructive rather than in any restrictive sense. Many other variants are possible within the scope of the claims hereunto appended. The invention is not to be limited to the specifics as shown here for purposes of illustration but only by the scope of the appended claims and their equivalents.

I claim:

1. A combination switch and socket adaptor, the switch having a conducting circuit, and the combination further comprising:

(a) a door engageable actuating arm including a pin slidingly engaged in a hollow member and extending from the switch and moveable from a first position with the circuit open to a second position with the circuit closed;

(b) a resilient means for urging the actuating arm into the second position;

(c) a pair of spaced fixed contacts disposed within the switch;

(d) a pair of spaced moveable contacts disposed within the switch and attached to the actuating arm;

(e) a socket adaptor housing having an upper portion threaded for receiving a light bulb, a lower housing portion, and an intermediate housing portion, the intermediate housing portion being eternally threaded for engagement with an existing light socket; and (f) conducting means for extending between the switch and the socket adaptor housing.

2. The combination switch and socket of claim 1, further comprising:

(g) a pair of conducting strips, each strip having a first end connected to a fixed contact and a second end connected to the conducting means.

3. The combination switch and socket of claim 2, in which:

(h) the actuating arm includes a pin having first and second opposed ends, the first end being engageable with a door and the second end being connected to the moveable contacts by a contact arm.

4. The combination switch and socket of claim 1, further comprising:

(i) a first conducting strip extending from inside the upper housing portion to outside the intermediate housing portion, the strip being positioned to contact a light bulb.

5. The combination switch and socket of claim 4, further comprising:

(j) a second conducting strip extending from inside the upper housing portion to inside the intermediate housing portion, the second strip having a first portion that lies generally flat in the upper housing for contacting the bottom of the light bulb.

6. The combination switch and socket of claim 5, further comprising:

(k) a third conducting strip extending from inside the intermediate housing portion to inside the lower housing portion, the third strip having a first portion that lies generally flat in the lower housing for forming an end that contacts the existing light socket.

7. The combination switch and socket of claim 6, further comprising:

(l) a cover made of conductive material encasing the lower housing portion and at least a portion of the intermediate housing portion.

8. The combination switch and socket of claim 7, in which:

(m) the first conducting strip is in contact with the cover.

9. The combination switch and socket of claim 8, in which:

(o) the conducting means includes a first wire and a second wire, each wire having a pair of ends.

10. The combination switch and socket of claim 9, in which:

(p) the second conducting strip has a second portion connected to the first wire; and (q) the third conducting strip has a second portion connected to the second wire.

11. A combination switch and socket comprising:

(a) a casing having means for securing near a door;

(b) an actuating arm extending from the casing and engageable with the door for opening a circuit, thereby turning off a light;

(c) a resilient means positioned within the casing to urge the actuating arm in the circuit closed position;

(d) a pair of contacts carried by the actuating arm;

(e) a pair of contact members in the casing each having first and second ends, the first ends providing a fixed contact;

(f) conducting means for connecting to the second ends of each of the contact members and the combination further including;

(g) a socket adaptor housing having an upper, an intermediate and a lower portion and being externally threaded for engagement with the socket and wherein the conducting means extends from the casing to the socket adaptor housing.

12. An automatic switch assembly for installation in an existing door comprising socket means for connecting to an existing socket source of electrical power and switch means for activating an electric light in response to opening and closing of the door, the switch means including:

(a) an actuating arm engageable with the door;

(b) a pair of contacts moveable from a circuit closed position to a circuit open position;

(c) a resilient means for urging the actuating arm outwards in the circuit closed position; and (d) conducting means for connecting the contacts and socket means.

13. The automatic switch assembly of claim 12, in which:

(e) the contacts include a first and second mating portion, the first portion being operatively attached to the actuating arm and moveable therewith.

14. The automatic switch assembly of claim 13, in which:

(f) the actuating arm includes a pin extending from the switch and engageable with the door.

15. The automatic switch assembly of claim 14, further comprising:

(g) a contact arm carrying the contact first portion and operatively attached to the pin.

16. The automatic switch assembly of claim 15, in which:

(h) the pin has a head engageable with a surface of the door for deactivating the electric light.

17. The automatic switch assembly of claim 16, wherein the door is a sliding door, and further comprising:

(i) a lever adjacent the pin head and engageable with the sliding door for deactivating the electric light.

18. The automatic switch assembly of claim 17, in which:

(j) the contact second portion is fixed within a casing surrounding the switch.

* * * * *